US007240427B2

(12) United States Patent
Ocket

(10) Patent No.: US 7,240,427 B2
(45) Date of Patent: Jul. 10, 2007

(54) PIN CONTACT AND METHOD AND APPARATUS FOR ITS MANUFACTURE

(75) Inventor: Tom Ocket, Torhout (BE)

(73) Assignee: Tyco Electronics Belgium EC N.V., Oostkamp (BE)

( * ) Notice: Subject to any disclaimer, the term of this patent is extended or adjusted under 35 U.S.C. 154(b) by 52 days.

(21) Appl. No.: 10/958,757

(22) Filed: Oct. 5, 2004

(65) Prior Publication Data

US 2005/0106906 A1 May 19, 2005

(30) Foreign Application Priority Data

Oct. 6, 2003 (EP) ..... 03256290

(51) Int. Cl.
*H01R 9/00* (2006.01)

(52) U.S. Cl. ..... 29/844; 29/842; 29/845

(58) Field of Classification Search ..... 29/842, 29/844, 845

See application file for complete search history.

(56) References Cited

U.S. PATENT DOCUMENTS 3,374,455 A * 3/1968 Sullivan et al. ..... 439/219
3,545,606 A * 12/1970 Lightner et al. ..... 206/716
3,553,635 A * 1/1971 Lundergan et al. ..... 439/853
3,848,120 A * 11/1974 Wolfe et al. ..... 362/549
3,850,493 A * 11/1974 Clewes et al. ..... 439/269.1
3,924,915 A * 12/1975 Conrad ..... 439/66
3,958,859 A * 5/1976 Schmid ..... 439/746
4,606,589 A 8/1986 Elsbree, Jr. et al.
4,639,056 A * 1/1987 Lindeman et al. ..... 439/61
5,014,419 A * 5/1991 Cray et al. ..... 29/830
5,054,192 A * 10/1991 Cray et al. ..... 29/835
5,899,757 A * 5/1999 Neidich et al. ..... 439/67
6,256,879 B1 * 7/2001 Neidich et al. ..... 29/843
6,336,269 B1 * 1/2002 Eldridge et al. ..... 29/885
2001/0021610 A1 9/2001 Otsuki et al.

* cited by examiner

*Primary Examiner*—Carl J. Arbes
(74) *Attorney, Agent, or Firm*—Barley Snyder LLC

(57) ABSTRACT

A pin contact for pressing into electrical engagement with a plated section in a hole in a circuit board. The contact includes a deformable portion for engaging the plated section with a feed-through portion and a terminal portion at opposite ends thereof. An end part of the deformable portion adjacent to the feed-through portion is deformed prior to insertion of the deformable portion into the hole. This substantially eliminates deviation of the feed-through portion from a central longitudinal axis or rotational deviation of the contact caused by pressing of the contact into the hole. A method and apparatus for making the contact are also disclosed.

10 Claims, 8 Drawing Sheets

PIN CONTACT AND METHOD AND APPARATUS FOR ITS MANUFACTURE

FIELD OF THE INVENTION

The present invention relates to a method of manufacturing a pin contact for electrical engagement with a plated through hole in a circuit board. The present invention also relates to such a contact and an apparatus for its manufacture.

BACKGROUND

Circuit boards are often provided with plated through holes for facilitating electrical connection to conductive traces on the board. Typically so-called pin contacts are provided for making such connections. A prior art pin contact 1 is shown in FIG. 1. The pin contact 1 includes a feed-through portion 2 for insertion into a plated through hole 10 (see FIG. 5) in a circuit board 12 and a deformable portion 4 (an enlarged view of which is shown in FIG. 2) at an end of the feed-through portion 2. The deformable portion 4 is adapted to be forced into a plated section 14 of a plated through hole 10 which is electrically connected to a layer 16 in the board 12. As this occurs the deformable portion 4 is deformed and makes the required electrical connection between the pin contact 1 and the plated section 14. A plurality of pin contacts are usually mounted in a connector with their feed through portions 2 projecting therefrom. The feed-through portions 2 of the connector are threaded into a plurality of plated through holes 10 in the board as the connector is moved towards the board the deformable portions 4 of the connectors are deformed as described above. Customarily a shroud or other device with a plurality of closely spaced plated through holes for receipt of the feed-through portions is threaded over the feed-through portions 2. As each deformable portion 4 of a connector is pressed into each plated section 14 it is squeezed. As this squeezing occurs however the feed-through portion 2 of each contact 1 tends to become misaligned with the deformable portion 4 thereof. This occurs because the deformable portion may not be symmetrically formed with respect to a central longitudinal plane thereof, for example in the case of a so-called eye of a needle pin contact, of the type shown in FIG. 1, an aperture 18 in the deformable portion 4 may not be exactly centrally located with respect to a width of the contact and the thickness of sections 20 on either side of the deformable portion 4 may not be equal. Such asymmetry causes the feed-through portion 2 to become bent away from a central longitudinal axis 22 of the contact 1 so that its tip 24 becomes displaced by a distance d shown in FIG. 3 from the axis 22. FIGS. 3 and 4 show the shape of the contact 1 after it has been partially inserted into plated through hole 10. The board 12 is shown schematically in dashed lines in FIGS. 3 and 4. Such displacement of the tips 24 of typical prior art contacts which have been pressed into plated through holes of various different diameters (a-0.65 mm, b-0.70 mm, c-0.75 mm, d-0.80 mm) is demonstrated in FIG. 7. It can be seen that when the contacts are pressed into relatively small holes their tips 24 tend to be displaced to a greater extent. Due to manufacturing tolerances for printed circuit boards a certain range of hole diameters should work. The disadvantage of pressing the contacts into relatively larger diameter holes, as shown in FIG. 7*d*, is that the electrical connection between the contacts and the plated sections 14 is less effective. There is usually a requirement to mount a shroud or other device with a plurality of closely spaced holes over the feed-through portions of the contacts which often proves difficult or even impossible as a consequence of the displacement of the tips 24.

The misalignment could also be in a direction perpendicular to the one shown in FIG. 3 which results is the same problem when a shroud is to be mounted over the pin. For other types of press fit zones or deformable portions the feed-through portion may rotate. If the rotation is high, electrical connection to the feed-through portion can not be guaranteed.

SUMMARY

It is therefore an object of the invention among others to provide a solution to the above problem. According to a first aspect of the invention there is provided a method of making a pin type contact for electrical engagement with a plated section of a plated through hole in a circuit board comprising the steps of: (a) forming a pin contact with a feed-through portion for insertion through the plated through hole in the circuit board and a deformable portion at one end of the feed-through portion for engaging the plated section of the plated through hole; and (b) squeezing an end of the deformable portion which is adjacent to the feed-through portion prior to engagement of the deformable portion with the plated section.

When the pin-contact is of a type other than an eye of a needle type, the squeezing step may be replaced by applying a deformation similar to partial insertion of the deformable portion into the hole.

BRIEF DESCRIPTION OF THE DRAWINGS

The invention will now be described by way of example only with reference to the accompanying drawings in which.

DETAILED DESCRIPTION OF THE EMBODIMENT(S)

Figures 12, 13A, 13B, 14:
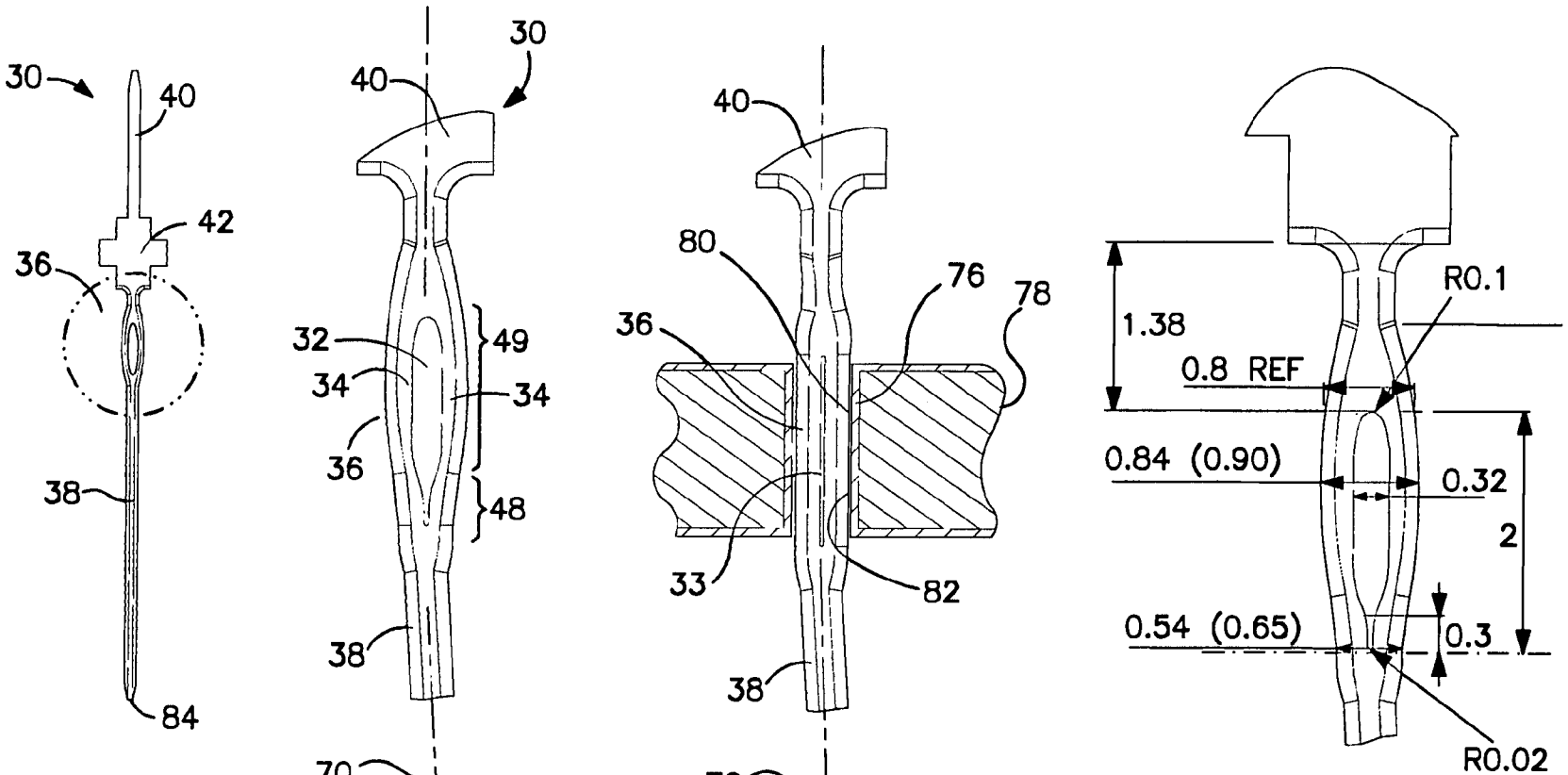
FIG. 12 shows a pin contact according to the invention.
FIG. 13*a* shows an enlarged portion of the pin contact of FIG. 12 ready for pressing into a plated through hole.
FIG. 13*b* shows a partial sectioned view of the contact of FIG. 13*a* pressed into a plated through hole in a board.
FIG. 14 shows a similar view to FIG. 13*a* with dimensions.

The invention will be described with particular reference to a so-called eye of a needle pin contact 30 of the type shown in FIGS. 12 and 13*a* having a deformable portion 36 which includes a gap 32 between two side sections 34, a feed-through portion 38 extending from one end of the deformable portion 36 and a terminal portion 40 extending from the opposite end of the deformable portion 36. The terminal portion 40 includes a root 42 where it joins the deformable portion 36 by which the terminal is connected to other similar pin contacts during at least some phases of its manufacture. The roots 42 are separated from each other prior to pressing the contacts into plated through holes in a circuit board.

Figure 1:
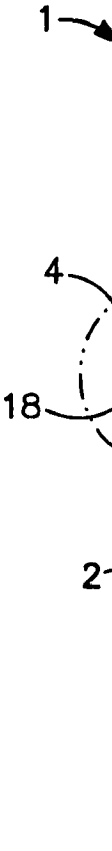
FIG. 1 PRIOR ART
FIG. 1 shows a prior art pin contact.
Figure 2:
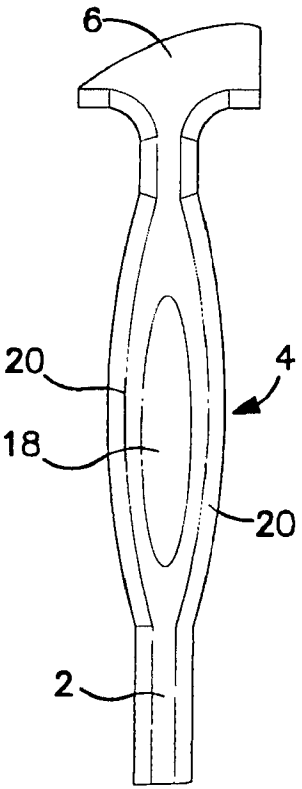
FIG. 2 PRIOR ART
FIG. 2 shows an enlarged portion of the pin contact of FIG. 1.
Figure 3:
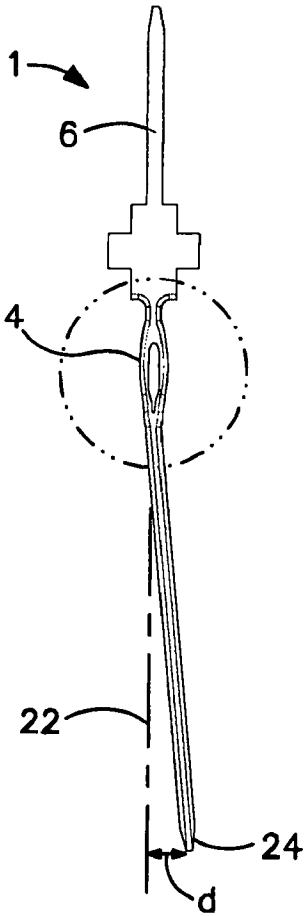
FIG. 3 PRIOR ART
FIG. 3 shows the shape of the prior art contact after partial insertion into a plated through hole in a circuit board.
Figure 4:
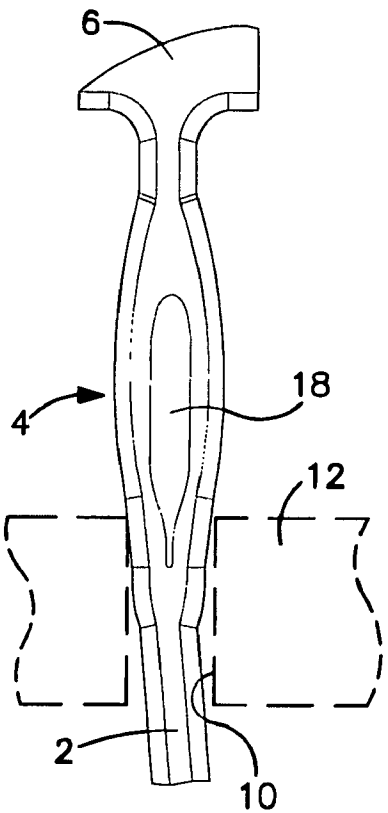
FIG. 4 PRIOR ART
FIG. 4 shows an enlarged portion of the contact shown in FIG. 3.
Figure 5:
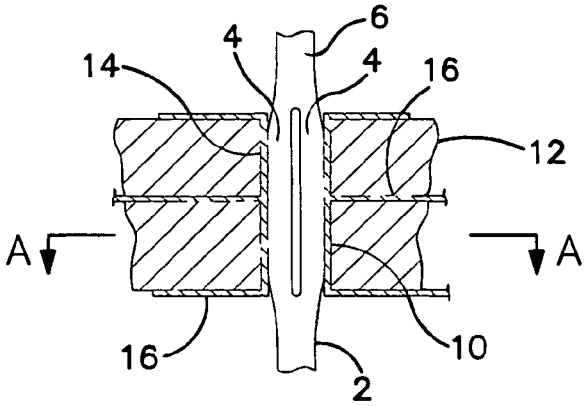
FIG. 5 PRIOR ART
FIG. 5 shows a portion of the prior art pin contact which has been pressed into a plated through hole in a circuit board.
Figure 6:
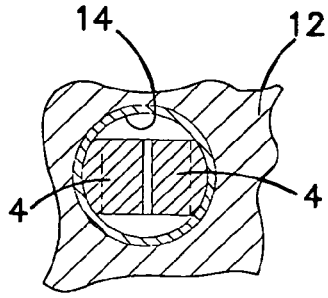
FIG. 6 PRIOR ART
FIG. 6 shows a cross section on the line A—A of the pin contact and board assembly of FIG. 5.
Figure 7:
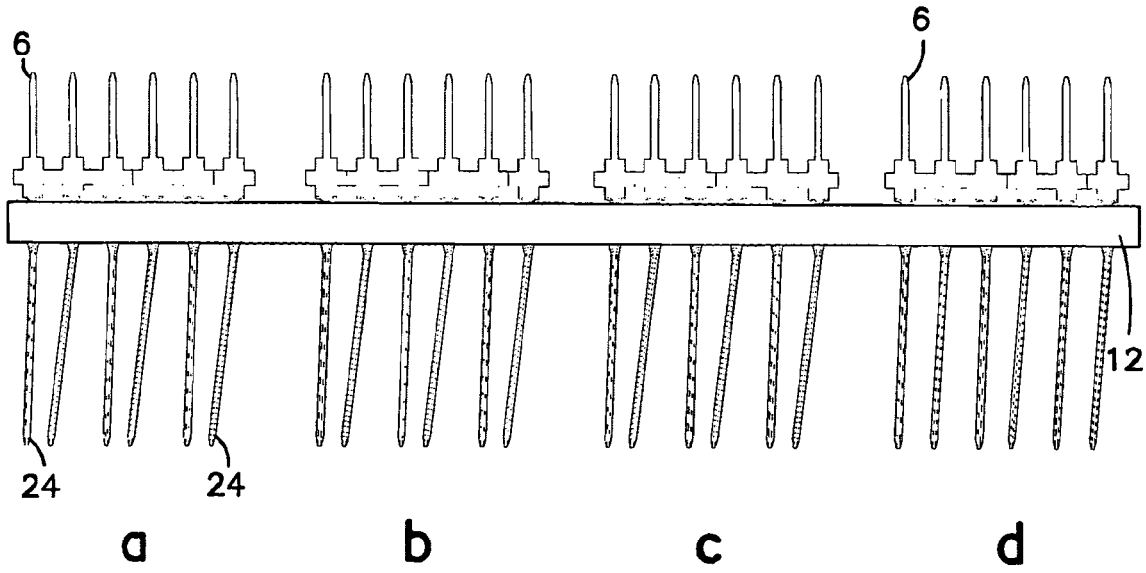
FIG. 7 PRIOR ART
FIG. 7 shows prior art pin contacts which have been press fitted into plated through holes of various different sizes.
Figure 8:
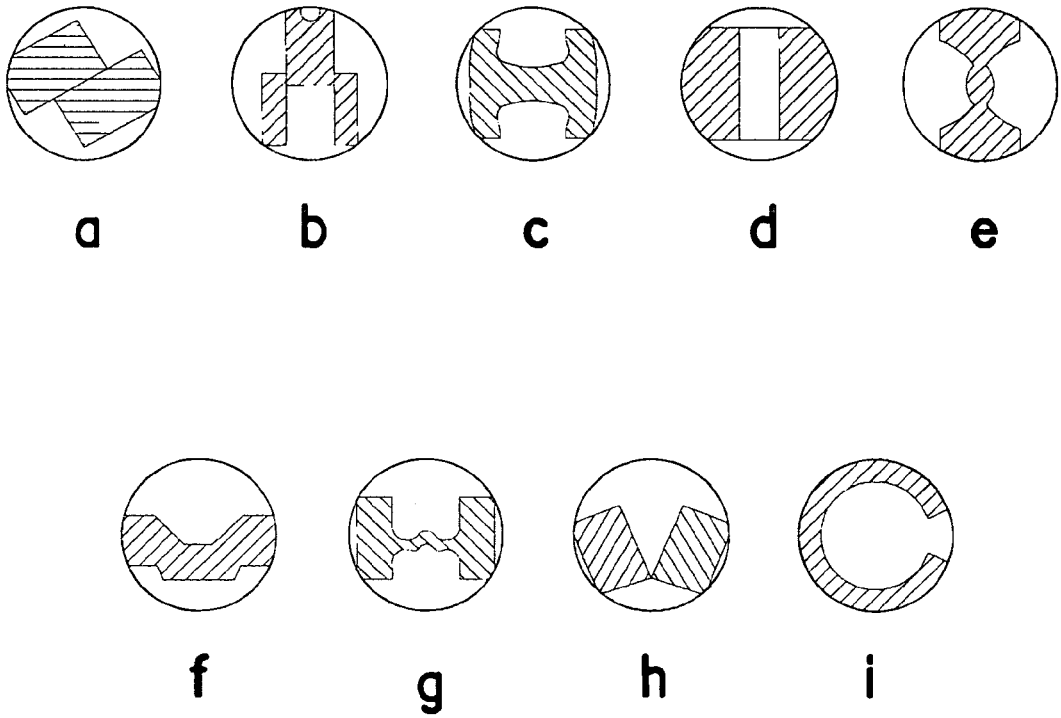
FIGS. 8*a* to 8*i* show some transverse sections through the deformable portions of various pin contacts to which the invention could be applicable.
Figure 9:
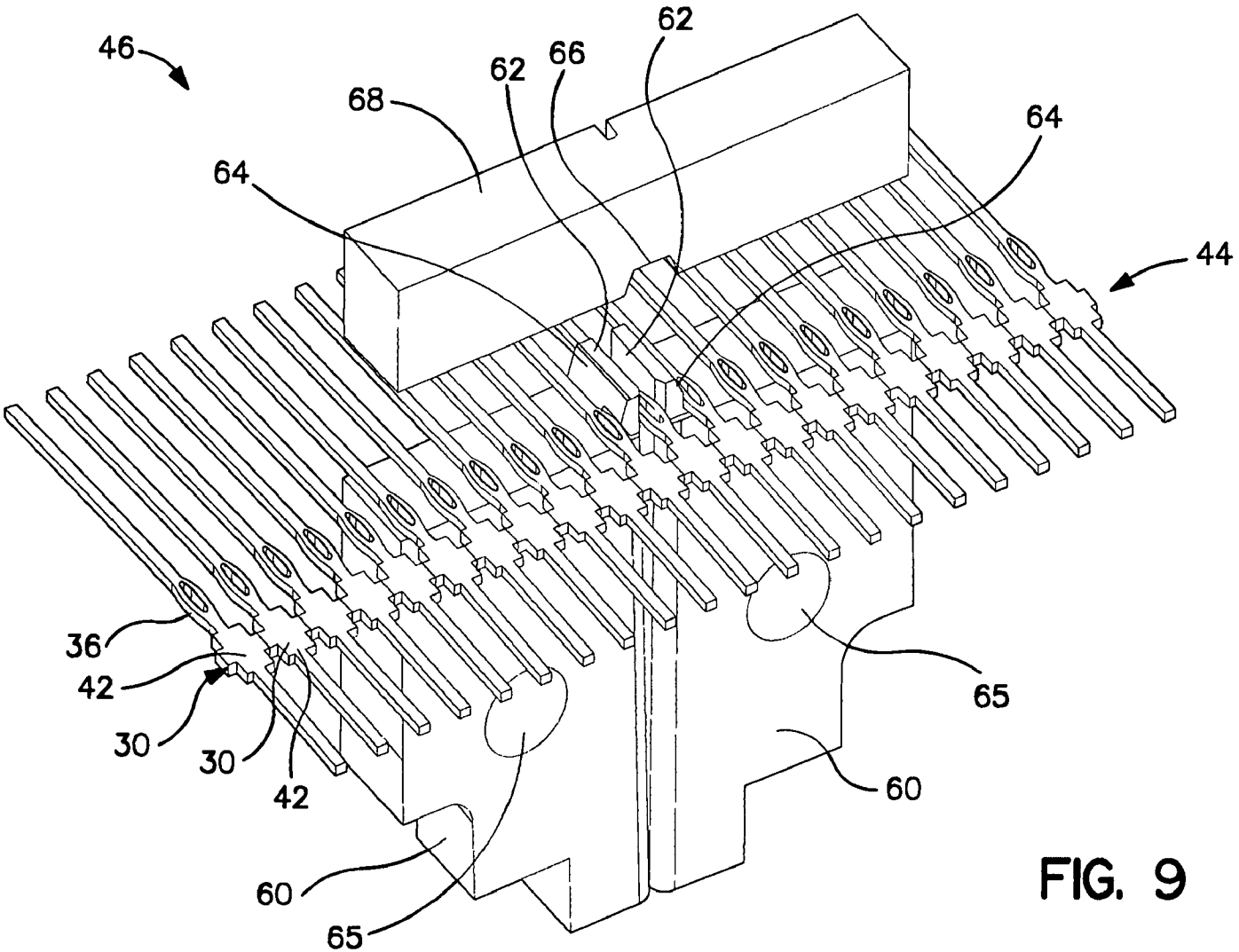
FIG. 9 shows a schematic perspective view of part of an apparatus for performing the method according to the invention.
Figure 11:
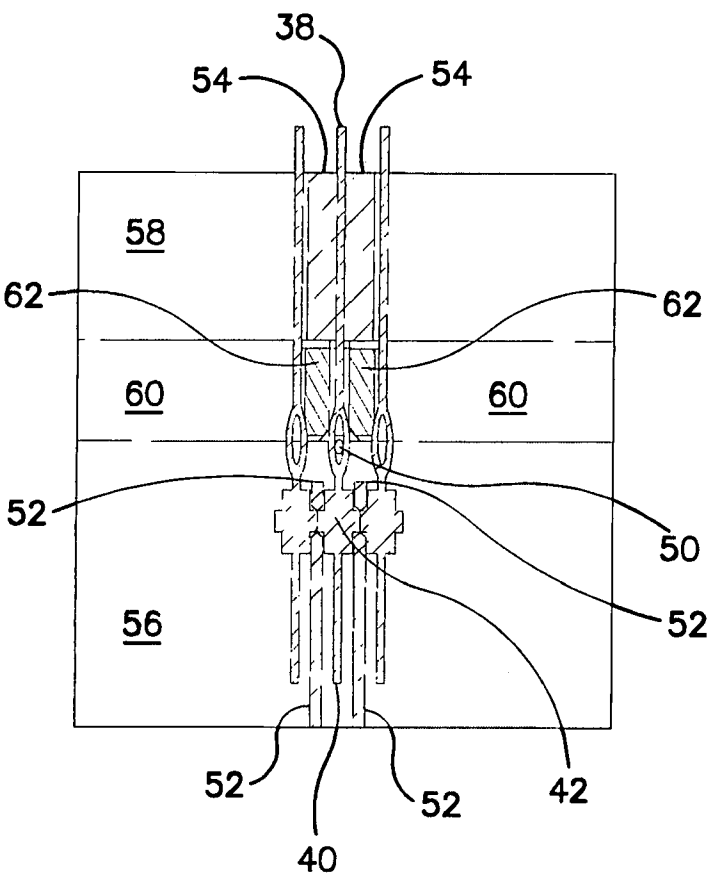
FIG. 11 shows a cross-section on the line B—B of the apparatus shown in FIG. 10.
Figure 10:
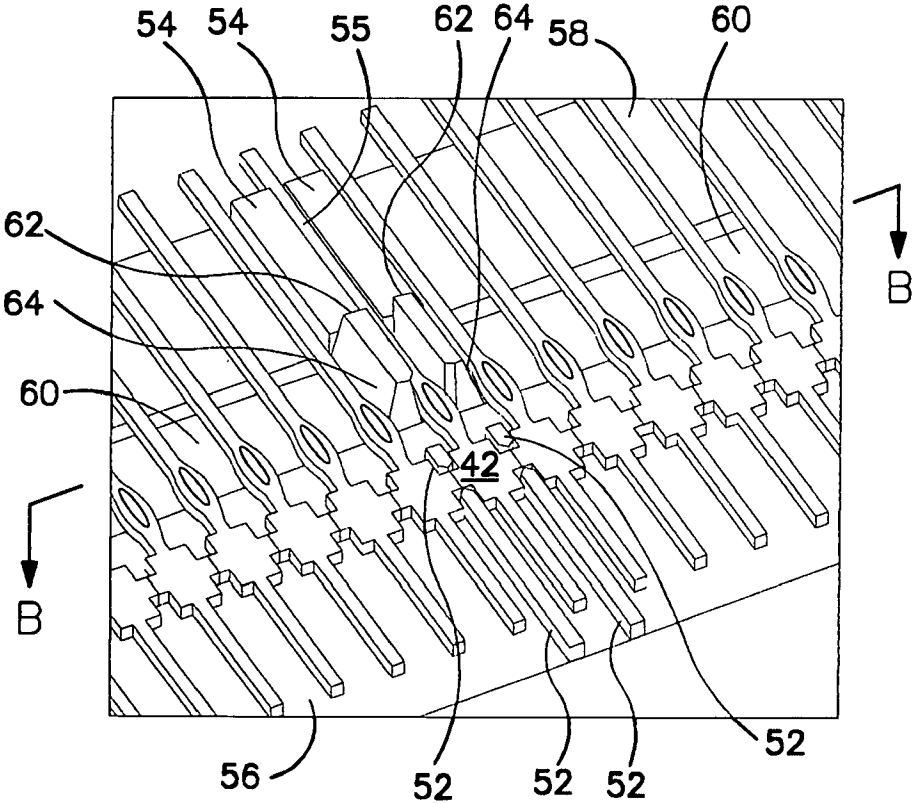
FIG. 10 shows a further schematic perspective view of part of the apparatus for performing the method according to the invention.

As shown in FIG. 9, first a strip 44 of pin contacts 30, each having the features referred to above, will be punched or otherwise formed from a sheet of stock metal with adjacent contacts joined by their roots 42. A squeezing apparatus 46, pertinent parts of which are shown in FIGS. 9 and 10, is then used to squeeze an end part 48 (FIG. 13*a*) of the deformable portion 36 of each contact 30 which is adjacent to the feed-through portion 38. The squeezing apparatus 46 includes first and second static parts 56 and 58 (FIG. 10) between which two displaceble jaws blocks 60 are provided each of which has an upstanding jaw 62 projecting therefrom with an outwardly facing cam surface 64 and a pivot pin about which it is pivotable. The two cam surfaces 64 are engageable by downward movement of a camming means or block 68 (FIG. 9) which has a downwardly open cam slot 66 formed in a lower surface thereof. The squeezing apparatus 46 includes a support member 50 shown in FIG. 11 which projects upwards between the jaws 62 and is positioned so that it occupies a part 49 of the gap 32 which is not the end part 48 of the gap to be squeezed. Depending on the shape of the deformable portion 36, the support member 50 may not be required and may be optionally removed. The first static part 56 includes restraint members in the form of four projections 52 which engage the root 42 of the contact between the jaws 60. The second static part 58 includes restraint members in the form of two projections 54 defining a slot 55 therebetween in which the feed-through portion 38 of the contact is snugly accommodated. The purpose of the projections 52, 54 is to prevent distortion of the contact and in particular the feed-through portion from occurring when squeezing of the end part 48 occurs. For other styles of deformable portion or press-fit zone something similar should be done to prevent too much deformation which could lead to low mechanical and electrical connection with the hole lining.

As the cam slot 66 engages the cam surfaces 64 of the jaws 62, the jaws 62 are moved towards each other thereby squeezing the end part 48 of the gap so as to substantially close the end part of the gap 32 between the side sections 34 thereof. By way of example, dimensions in mm of the deformable portion 36 of the contact 30 after this squeezing operation are shown in FIG. 14 with some pre-squeezing dimensions given in brackets. It should also be noted here that the squeezing or deformation is less than would result in full insertion into the hole. For the so-called eye of a needle contact shown in this example, the deformation corresponds to that which would result from partial insertion of the deformable portion 36 into plated through hole 10. For other deformable portions or press-fit zones the deformation could be similar to that caused by insertion into bigger holes.

Figure 15:
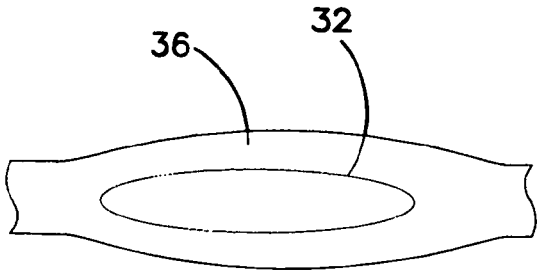
FIG. 15 shows a deformable portion of a pin contact of the type to which the invention can be applied.
Figure 16:
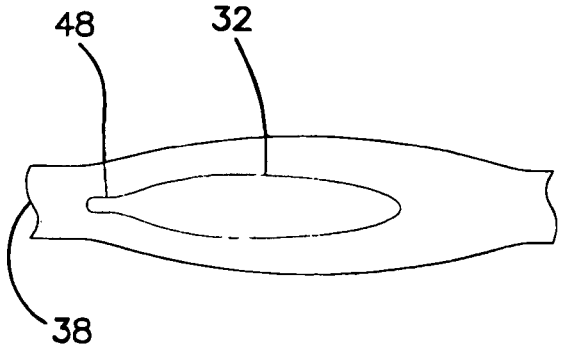
FIG. 16 shows the pin contact of FIG. 15 after squeezing.

Renditions of the deformable portion of the contact before and after this squeezing operation are shown respectively in FIGS. 15 and 16.

Figure 18:
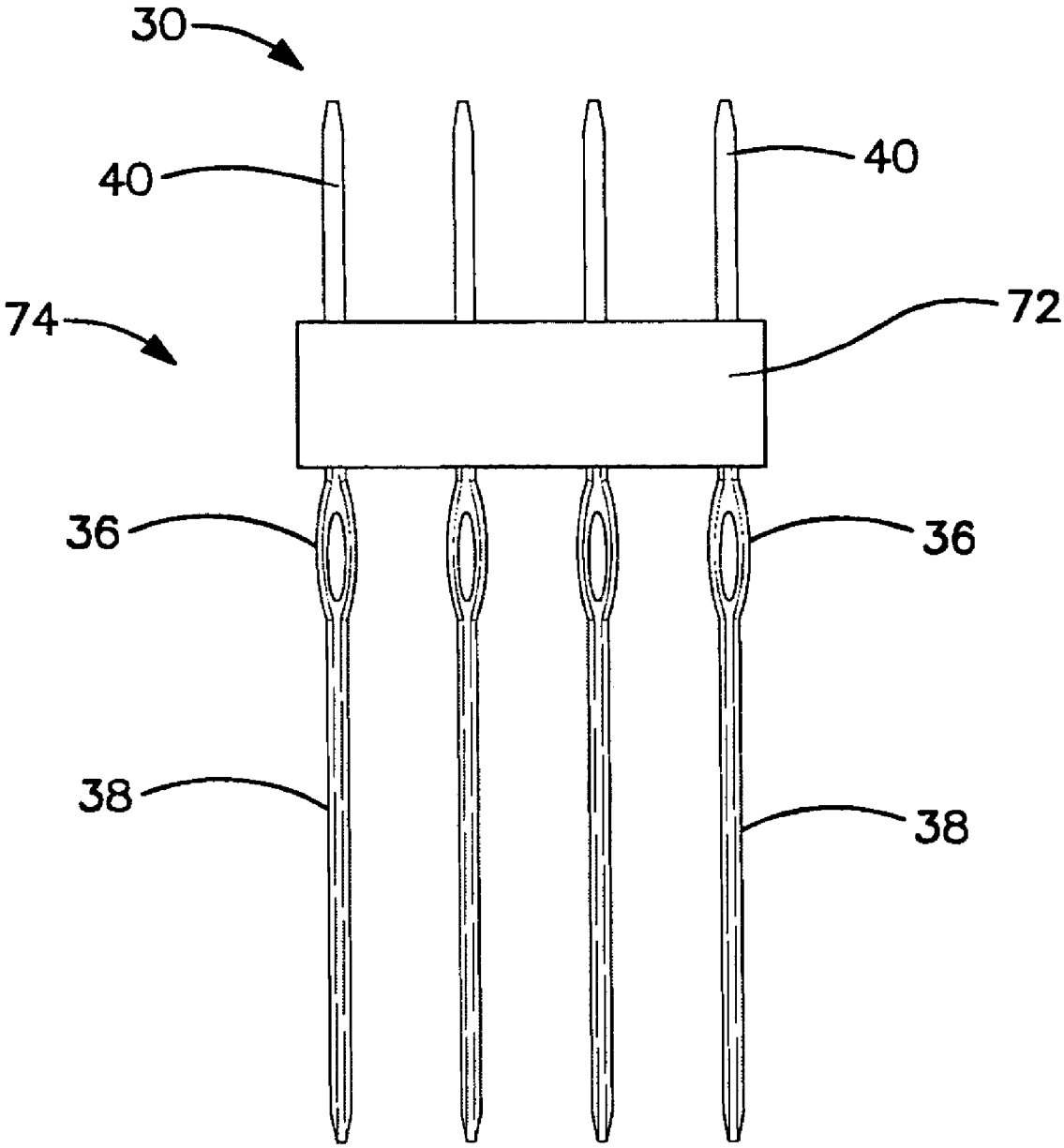
FIG. 18 shows a side view of a connector formed according to one aspect of the invention.

If the feed-through portion 38 becomes misaligned with respect to a central longitudinal axis 70 of the contact, this misalignment can be corrected after the strip 44 of contacts has been removed from the squeezing apparatus 46. The contacts can be supplied to a customer connected to each other as a strip 44 or separated from each other. A plurality of contacts 30 may be mounted in a housing 72 to form a connector 74 with their terminal portions 40 and feed-through portions 38 projecting from opposite sides of the housing as shown in FIG. 18.

When there is a requirement to electrically engage one of the contacts 30 with a plated section 76 of a plated through hole 80 in a circuit board 78, the feed through portion 38 is threaded through a plated through hole 80 in the plated section 76 until the squeezed end part 48 of the deformable portion 36 is just inside the plated through hole 80. The deformable portion 36 is then pressed fully or substantially fully into the plated through hole 80 to the position shown in FIG. 13*b* which causes the gap 32 to at least substantially close up as shown by reference numeral 33. Due to the pre-squeezing of the end part 48 of the deformable portion 36, the process of pressing the deformable portion 36 into the plated through hole 80 does not result in any significant distortion of the feed-through portion 38 which remains at least substantially aligned with the longitudinal axis 70 of the contact.

The inventor has discovered that the majority of the displacement of the contact tip is caused as a leading part of the deformable portion 36 is pressed into the plated through hole 80. By using the method according to the invention, a contact with no or substantially no tip displacement resulting from the squeezing or partial deformation of the leading part of the deformable portion 36 can be provided to a board manufacturer. The contact will be in a condition in which it can be pressed into a plated through hole 80 in a board 78 and undergo virtually no tip displacement since deformation of other parts of the deformable portion 36 have very little effect on tip displacement. This in turn makes it easy for the board manufacturer to mount a shroud or other similar device over the feed-through portions 38 of a plurality of contacts which have been pressed into plated through holes 80 in the board.

When a plurality of contacts 30 have been mounted in a connector 74 then the pressing of the deformable portions 36 of the contacts into a plurality of plated through holes will take place simultaneously.

Figure 17:
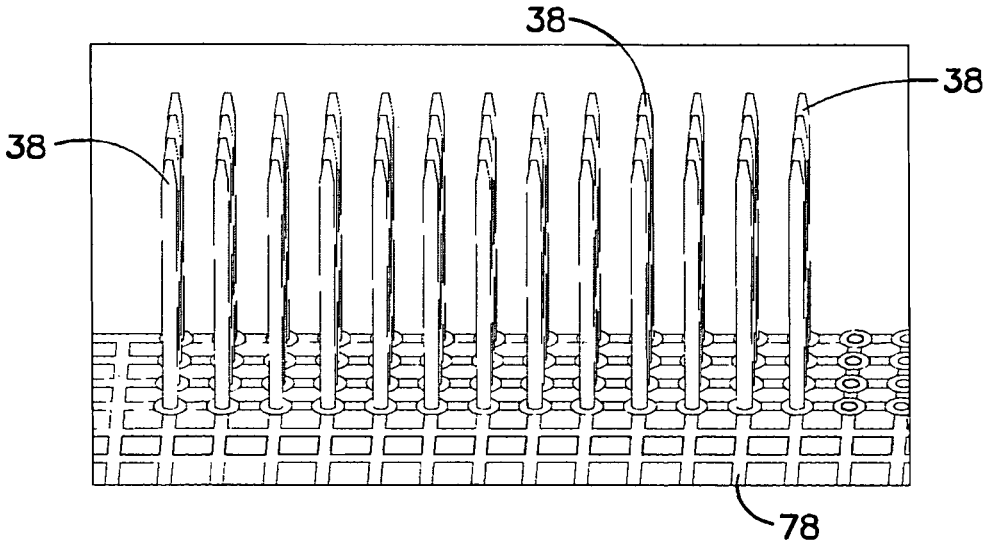
FIG. 17 is a perspective view showing the feed through-portions of a plurality of pin contacts according to the invention which have been pressed into plated through holes in a circuit board.

FIG. 17 shows a view of the feed-through portions 38 of contacts (having 0.04 mm lateral deviation of the gap from the contact centreline) which have been prepared in accordance with the invention after the contacts have been pressed into complementary plated through holes in a 4.6 mm thick circuit board 78. It can be seen that the feed-through portions are all well aligned with each other and perpendicular to the surface of the circuit board.

What is claimed is:

1. A method of making a pin type contact for electrical engagement with a plated section of a plated through hole in a circuit board comprising the steps of:

forming a pin contact with a feed-through portion for insertion through the plated through hole in the circuit board and a deformable portion at one end part of the feed-through portion for engaging the plated section of the plated through hole;

partially deforming an end part of the deformable portion which is adjacent to the feed-through portion prior to insertion of the deformable portion into the plated through hole;

wherein the partially deforming step involves reducing a gap between spaced sections of the deformable portion;

prior to the partially deforming step, positioning a support member between parts of the spaced sections not to be partially deformed together in the partially deforming step;

wherein the contact is a so-called eye of a needle contact with a gap situated in a region occupied by the deformable portion and the partially deforming step involves reducing a width of the gap at one end part thereof.

2. The method of claim 1 wherein, during the partially deforming step, the portions of the contact are held in longitudinal alignment with each other.

3. A method of making a pin type contact, the pin type contact having a deformable portion which includes a gap between two side sections, a feed-through portion extending from one end of the deformable portion, and a terminal portion extending from the opposite end of the deformable portion, and the deformable portion having an end part adjacent the feed-through portion, the method comprising the step of:

deforming the end part so as to lessen the gap between the two side sections located within the end part;

wherein the pin type contact is an eye of a needle pin contact.

4. A method of making a pin type contact, the pin type contact having a deformable portion which includes a gap between two side sections, a feed-through portion extending from one end of the deformable portion, and a terminal portion extending from the opposite end of the deformable portion, and the deformable portion having an end part adjacent the feed-through portion, the method comprising the steps of:

deforming the end part so as to lessen the gap between the two side sections located within the end part; and preventing distortion of the terminal portion and the feed-through portion while the end part is being deformed.

5. A method of making a pin type contact, the pin type contact having a deformable portion which includes a gap between two side sections, a feed-through portion extending from one end of the deformable portion, and a terminal portion extending from the opposite end of the deformable portion, and the deformable portion having an end part adjacent the feed-through portion, the method comprising the step of:

deforming the end part so as to lessen the gap between the two side sections located within the end part;

wherein the end part is deformed by locating the end part between two displaceable jaw blocks and displacing the jaw blocks toward each other.

6. The method of making a pin type contact according to claim 5, wherein the jaw blocks are displaced toward each other by lowering a camming means into engagement with the jaw blocks.

7. A method of making a pin type contact, the pin type contact having a deformable portion which includes a gap between two side sections, a feed-through portion extending from one end of the deformable portion, and a terminal portion extending from the opposite end of the deformable portion, and the deformable portion having an end part adjacent the feed-through portion, the method comprising the step of:

deforming the end part so as to lessen the gap between the two side sections located within the end part;

wherein the pin type contact remains connected to a second pin type contact throughout the deforming of the end part.

8. A method of making a pin type contact for electrical engagement with a plated section of a plated through hole in a circuit board comprising the steps of:

forming a pin contact with a feed-through portion for insertion through the plated through hole in the circuit board and a deformable portion at one end part of the feed-through portion for engaging the plated section of the plated through hole; and squeezing or partially deforming an end part of the deformable portion which is adjacent to the feed-through portion prior to engagement of the deformable portion with the plated through hole lining;

wherein the squeezing step involves reducing a gap between spaced sections of the deformable portion and prior to the squeezing step, positioning a support member between parts of the spaced sections not to be squeezed together in the squeezing step.

9. The method of claim 8, wherein the contact is a so-called eye of a needle contact with a gap situated in a region occupied by the deformable portion and the squeezing step involves reducing a width of the gap at one end part thereof.

10. The method of claim 9, wherein during the squeezing step, the portions of the contact are held in longitudinal alignment with each other.

* * * * *